US006994050B2

(12) United States Patent
Johnson et al.

(10) Patent No.: US 6,994,050 B2
(45) Date of Patent: Feb. 7, 2006

(54) STORAGE DEVICES FOR BOATS

(76) Inventors: Cathy Johnson, 16514 Forestlake Dr., Tampa, FL (US) 33624; Russ Jacob Post, 16970 Tarpon Way, North Fort Myers, FL (US) 33917

( * ) Notice: Subject to any disclaimer, the term of this patent is extended or adjusted under 35 U.S.C. 154(b) by 0 days.

(21) Appl. No.: 10/768,546

(22) Filed: Jan. 30, 2004

(65) Prior Publication Data

US 2005/0166828 A1 Aug. 4, 2005

(51) Int. Cl.
*B63B 17/00* (2006.01)

(52) U.S. Cl. ..... 114/343; 224/406

(58) Field of Classification Search ..... 114/343; 224/406; 383/23

See application file for complete search history.

(56) References Cited

U.S. PATENT DOCUMENTS

| | | | | |
|---|---|---|---|---|
| 3,938,276 A | | 2/1976 | Mettler | 43/55 |
| 4,724,791 A | * | 2/1988 | McSorley | 114/343 |
| 4,844,207 A | | 7/1989 | Andrews et al. | 182/151 |
| 4,854,530 A | | 8/1989 | Baglio | 248/95 |
| 4,901,899 A | * | 2/1990 | Barrett | 224/223 |
| 4,970,821 A | * | 11/1990 | Young | 43/54.1 |
| 5,125,519 A | | 6/1992 | Cambria | 211/118 |
| 5,326,175 A | * | 7/1994 | Carter | 383/22 |
| 5,370,246 A | | 12/1994 | Traynor | 211/86 |
| 6,213,316 B1 | | 4/2001 | Gretz | 211/113 |
| 6,233,765 B1 | | 5/2001 | Verhulst | 5/503.1 |
| 6,296,128 B1 | | 10/2001 | Isserstedt | 211/113 |
| 6,327,993 B1 | | 12/2001 | Richens, Jr. | 114/361 |
| 6,408,779 B1 | | 6/2002 | Roy | 114/255 |
| 6,584,926 B1 | | 7/2003 | Schmitt et al. | 114/361 |
| 2002/0026891 A1 | | 3/2002 | Giffin et al. | 114/361 |
| 2002/0030028 A1 | | 3/2002 | Isserstedt | 211/113 |
| 2002/0050551 A1 | | 5/2002 | Yamada et al. | 248/500 |
| 2003/0075955 A1 | | 4/2003 | Tiesler et al. | 296/214 |
| 2003/0089294 A1 | * | 5/2003 | Biemiller | 114/343 |
| 2003/0089749 A1 | | 5/2003 | Valdez-Campbell | 224/153 |

FOREIGN PATENT DOCUMENTS

JP 2002-39132 6/2002

OTHER PUBLICATIONS

"Marine T-Top Accessories," http://www.tpakmarine.com/what_is_a_tpak.htm, (3 pages) (visited Jan. 30, 2004).

(Continued)

*Primary Examiner*—Jesus D. Sotelo
(74) *Attorney, Agent, or Firm*—Buchanan Ingersoll PC

(57) ABSTRACT

Various embodiments of storage devices for a boat are provided. One embodiment is a storage device for removably attaching to a t-top on a boat and for storing items. One such storage device comprises: a frame comprising marine fabric having an opening to a storage area defined by the frame for receiving an item; an access flap for enabling a user to access the storage area, the access flap comprising marine fabric attached to a top portion of the frame and extending over the opening to a bottom portion of the frame for securing the access flap to the bottom portion of the frame; and a plurality of straps attached to the bottom portion of the frame for providing support from underneath the frame when it is attached to a t-top on a boat, each of the plurality of straps having a first end for attaching to a first horizontal structure of the t-top and a second end for attaching to a second horizontal structure of the t-top.

10 Claims, 6 Drawing Sheets

OTHER PUBLICATIONS

"Marine T-Top Accessories," http://www.tpakmarine.com/tpak_installation.htm, (2 pages) (visited Jan. 30, 2004).
"TPak Marine—Boating Storage Made Easy," http://www.yachtsee.com/tpak.htm (2 pages) (visited Jan. 30, 2004).
"TPak Marine—Boating Storage Made Easy," http://www.yachtsee.com/tpakhardtop.htm (1 page) (visited Jan. 30, 2004).
"T-Pak Colors and Sizes," http://www.yachtsee.com/tpak3.htm (2 pages) (visited Nov. 20, 2003).
"Beach Pockets'Many Uses," http://www.beachpockets.com/pages/manyuses.html (1 page) (visited Nov. 11, 2003).
"Beach Pockets: How They Work," http://www.beachpockets.com/pages/howitworks.html (1 page) (visited Nov. 11, 2003).
"Maxima Storage Mesh Pockets," http://www.cabelas.com/information/Marine/Maxima-Storage-Mesh-Pockets.html (1 page) (visited Nov. 11, 2003).
"Making Your Own Boat Pockets," Sailrite Enterprises, Inc., 2002 (3 pages).

* cited by examiner

300
Y-AXIS
314
304
402
402
304

300
310
314
312
302
304
304
304
314
308
Y-AXIS

STORAGE DEVICES FOR BOATS

BACKGROUND

Currently, there are a number of different types of boats for any number of recreational and/or commercial uses. Most boats are manufactured with some form of on-board storage for storing various items (e.g., personal items, supplies, life preservers, fishing tackle, etc.). For example, some boats include a glove box compartment, a seat back pouch, under-bow storage space, and under-seat storage devices, to name a few.

Existing on-board storage solutions, however, have numerous limitations. Many existing storage solutions are not very convenient because they are located in areas that may be difficult for boaters to easily access. Other storage solutions are problematic because they occupy space on the boat that may be more advantageously used for other purposes. Many existing storage solutions do not offer adequate space for storing certain types of items. Furthermore, some storage solutions do not enable the items to be organized in a useful manner.

Yet another limitation of many existing storage solutions for boats is that they generally can only be used in one location on the boat. For example, many existing devices are manufactured with the boat and, therefore, cannot be moved to alternative and possibly more convenient locations. Devices that may be installed, mounted, etc. on a boat do not provide the desired level of flexibility/convenience. For instance, most of these types of storage devices can only be installed in one location (e.g., pouches screwed to seat backs). Therefore, in situations where additional storage space is needed, multiple types of devices are often used, which may be time consuming, expensive, and inconvenient. Therefore, there is a need in the industry for improved storage devices for boats.

SUMMARY

Various embodiments of storage devices for boats are provided. One embodiment is a storage device for removably attaching to a t-top on a boat and for storing items which comprises: a frame comprising marine fabric having an opening to a storage area defined by the frame for receiving an item; an access flap for enabling a user to access the storage area, the access flap comprising marine fabric attached to a top portion of the frame and extending over the opening to a bottom portion of the frame for securing the access flap to the bottom portion of the frame; and a plurality of straps attached to the bottom portion of the frame for providing support from underneath the frame when it is attached to a t-top on a boat, each of the plurality of straps having a first end for attaching to a first horizontal structure of the t-top and a second end for attaching to a second horizontal structure of the t-top.

Another embodiment is a storage device for removably attaching to structures on a boat and for storing items which comprises: a support member comprising marine fabric; at least one pocket member comprising marine fabric which is attached to the support member for forming a pocket on the front side of the support member and for receiving an item to be stored on the boat; and a plurality of straps attached to the support member along a vertical axis of the support member, each of the plurality of straps for removably attaching the storage device to a structure on the boat by extending a first end portion at least partially around the structure along the vertical axis and attaching to the remaining portion of the corresponding strap.

Another such storage device comprises: a support member comprising marine fabric having two opposing sides on a vertical longitudinal axis which are disposed in an oblique relationship to each other; at least one pocket member comprising marine fabric which is attached to the support member for forming a pocket on the front side of the support member and for receiving an item to be stored on the boat; and a plurality of straps attached to the support member in a substantially perpendicular relationship to the longitudinal axis of the support member, each of the plurality of straps having a first end for attaching to a first vertical structure and a second end for attaching to a second vertical structure, the first and second vertical structures being disposed in an oblique relationship to each other.

BRIEF DESCRIPTION OF THE DRAWINGS

Many aspects of the invention can be better understood with reference to the following drawings. The components in the drawings are not necessarily to scale, emphasis instead being placed upon clearly illustrating principles in accordance with exemplary embodiments of the present invention. Moreover, in the drawings, like reference numerals designate corresponding parts throughout the several views.

DETAILED DESCRIPTION

This disclosure relates to various embodiments of storage devices for boats. Several exemplary embodiments will be described with respect to FIGS. 1–7. It will be appreciated, with reference to the following description and the drawings, that these exemplary embodiments of storage devices (as well as others) may be removably attached to existing structure(s) on any of a number of types of boats. For example, many existing boats are manufactured or retrofitted with any of the following, or other, structure(s), on which these storage devices may be removably attached: t-top, hardtop, outrigger, tower, half-tower, boarding arch, fishing arch, radar arch, sailing arch, deck cover, seats, leaning post(s), seat back, aluminum piping, etc. One of ordinary skill in the art will further appreciate that these storage devices may be conveniently attached/detached from any of a number of alternative structure(s) that exist, or may be installed, on boats of any type.

The various embodiments of storage devices offer a portable, convenient, and flexible solution for providing on-board storage for various types of items (e.g., personal items, supplies, life preservers, fishing tackle, etc.). One of ordinary skill in the art will appreciate that the storage devices may be appropriately configured and sized to accommodate the spatial and/or structural orientation of any installation target, as well as the target items to be stored.

Figure 1:
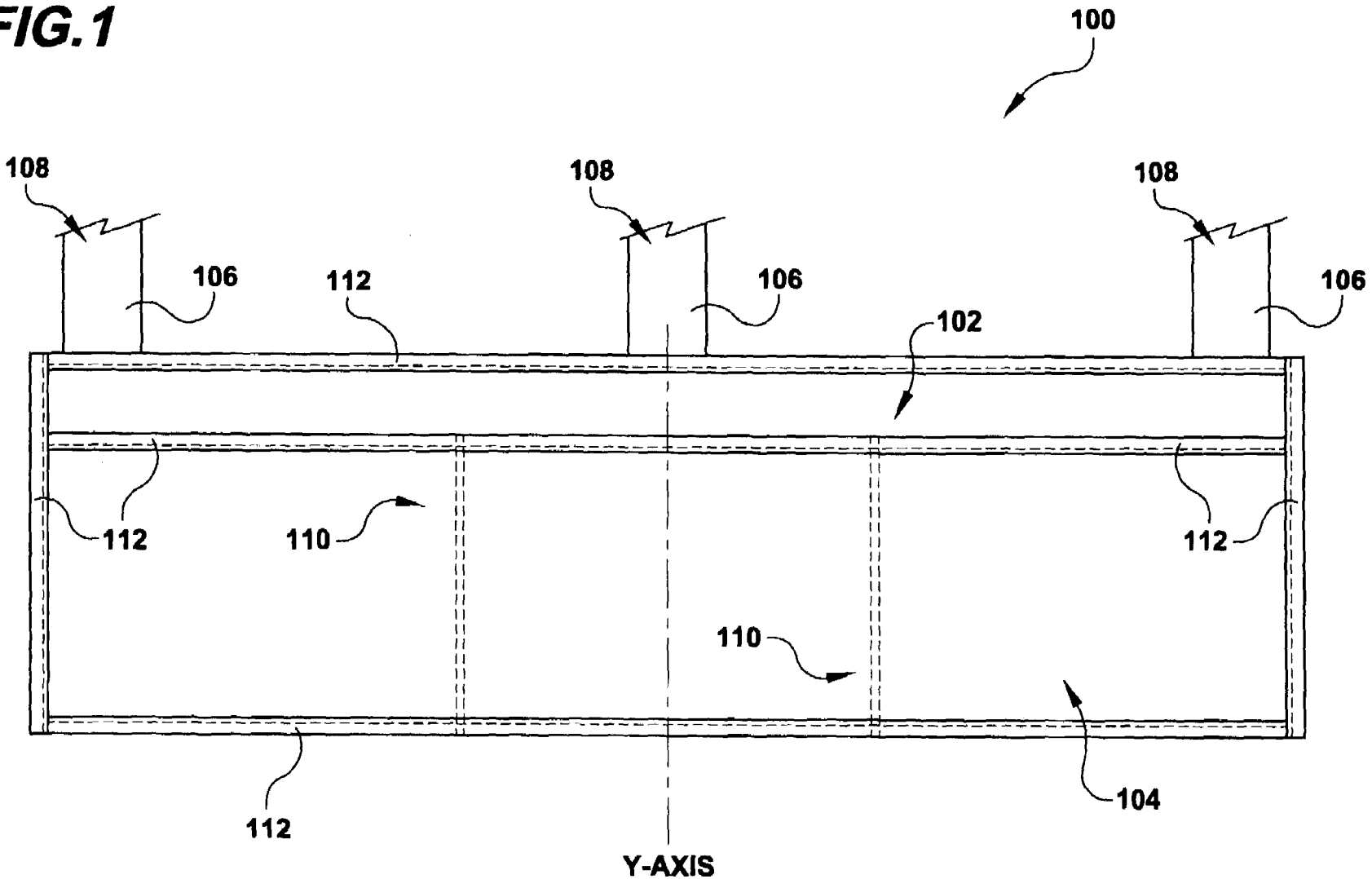
FIG. 1 is a front view of one of a number of embodiments of a storage device for a boat.
Figure 2:
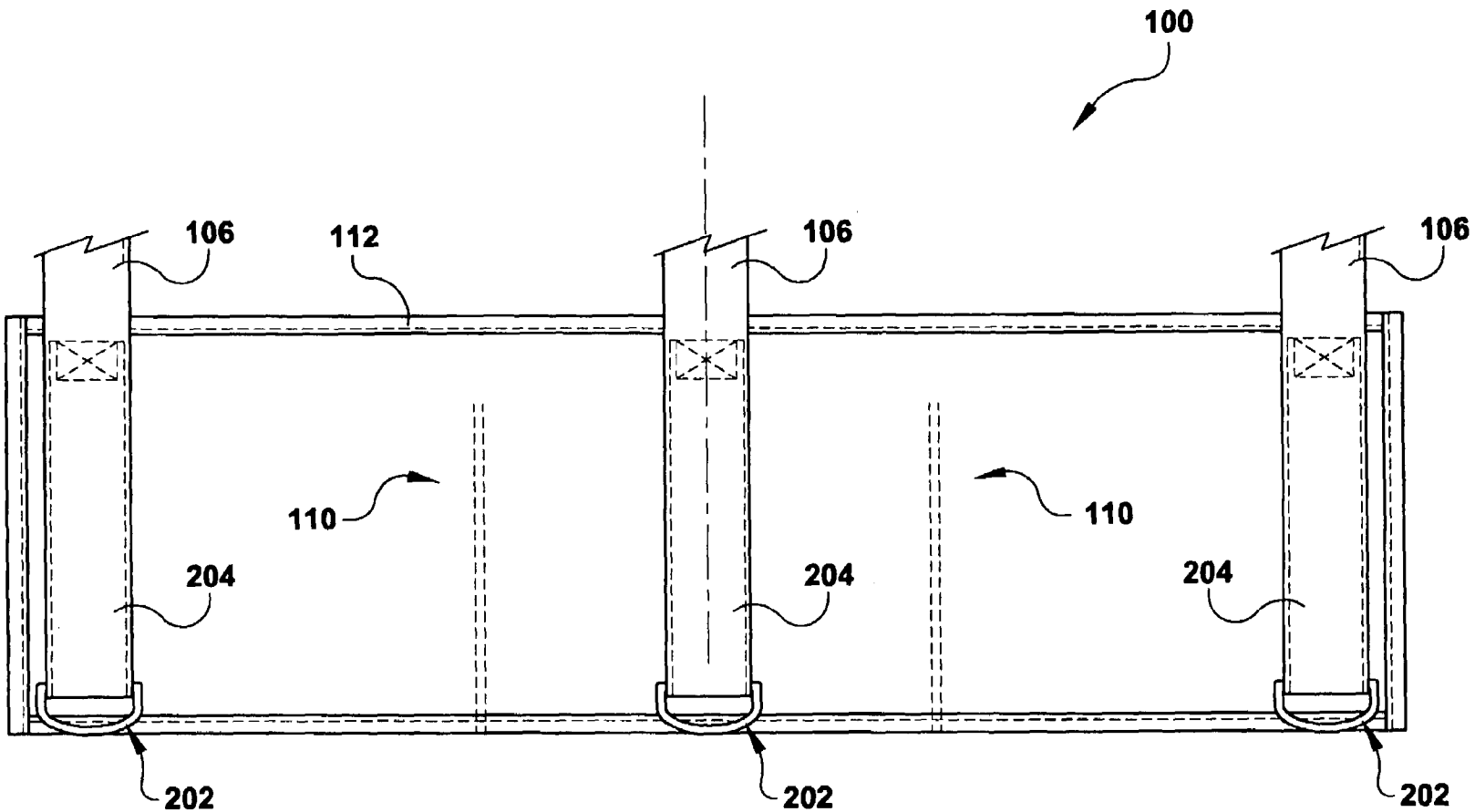
FIG. 2 is a back view of the storage device of FIG. 1.

Having described the general structure and operation of various storage devices for boats, several exemplary embodiments will be described with respect to FIGS. 1–7. FIGS. 1 and 2 illustrate an embodiment of a storage device 100 for removably attaching to structure(s) on a boat of the types generally described above. As illustrated in FIG. 1, storage device 100 comprises a support member 102, pocket member 104, and straps 106. Support member 102 provides an appropriate support or backing on which pocket member(s) 104 may be attached for forming a pocket in which various types of items may be stored. In one embodiment, support member 102 and/or pocket member(s) 104 comprise a piece of marine fabric. One of ordinary skill in the art will appreciate that any of a number of alternative materials, fabrics, etc. may be used. For example, in certain embodiments, support member 102 and/or pocket member(s) 104 may comprise any of the following, or other materials: acrylic material, woven vinyl-coated polyester fabric, acrylic fiber, etc.

As briefly stated above, storage device 100 may comprise one or more pocket members 104. Pocket members 104 may be attached to the front side of support member 102 in a number of ways to form the corresponding pocket(s). For example, a pocket member 104 may be stitched to the front side of support member 102 with thread, such as marine thread. As illustrated in FIGS. 1 & 2, pocket member 104 may be stitched to the front side of support member 102 at each of the edges except a top edge, which remains unattached to support member 102, to form the corresponding pocket.

In certain embodiments, a plurality of pocket member(s) 104 may be attached to support member 102. It should be appreciated that pocket members 104 may be positioned in any convenient way on support member 102. For instance, a plurality of horizontal pockets may be formed by attaching two pocket members 104 next to each other. Alternatively, pocket members 104 may be positioned in a vertical arrangement along the y-axis (FIGS. 1 & 2) to form vertically-aligned pockets. Furthermore, any combination of horizontally-aligned and/or vertically-aligned pockets may be formed on support member 102.

It should be further appreciated that a plurality of pockets may be formed by stitching a divider 110 in an existing pocket member 104. In this manner, a single pocket member 104 may be converted into two smaller pocket members 104 because divider 110 serves as the barrier between the two pockets.

As mentioned above, pocket member(s) 104 may be attached to support member 102 in a number of ways. For example, referring to FIGS. 1 & 2, pocket member 104 may be formed from a bottom portion of support member 102 by folding support member 102 along, for example, an axis orthogonal to the y-axis, and attaching the folded portion to support member 102 as described above. In this manner, the folded portion (i.e., pocket member 104) forms the pocket. One of ordinary skill in the art will appreciate that labor costs may be reduced by forming the pocket from support member 102 because separate pocket members 104 do not need to be cut and separately attached.

As further illustrated in FIG. 1, storage device 100 may further comprise a reinforcing material 112 (e.g., acrylic binding material, canvas material, epoxy, etc.) which is attached to the various edges of support member 102 and/or pocket member(s) 104. For example, in the embodiment illustrated in FIGS. 1 & 2, reinforcing material 112 comprises an acrylic binding material which is stitched to various edges of support member 102 and pocket member 104. It should be appreciated that reinforcing material 112 may improve the durability of storage device 100 at, for example, the edges of the device where durability and wear may be an issue.

As best illustrated in FIG. 2, storage device 100 may be removably attached to various structure(s) on a boat as described above via a plurality of straps 106. By way of example, storage device 100 may be removably attached to a seat back, or any other suitable structure(s). Straps 106 may comprise a variety of materials, fabrics, etc. In one embodiment, straps 106 comprise web strapping. Any number of straps 106 may be employed as necessary to attach storage device 100. For example, depending on factors such as the size of storage device 100, the number of pockets, the size, dimensions and weight of the items being stored, the spatial and structural orientation of the target structure(s), etc., additional straps 106 may be used.

As illustrated in FIG. 2, straps 106 may be attached to the back side (i.e., the opposite side of the pockets) of support member 102 along the y-axis (FIG. 1). Straps 106 may include a first end portion 108 which may be used to at least partially extend around the target structure(s) and attach to the remaining portion 204 of the corresponding strap 106. In this manner, each strap 106 may be wrapped around the target structure(s) and attached to support member 102 or remaining portion 204 and, thereby, secure storage device 100 to the structure(s).

It should be appreciated that straps 106 may be attached in a number of ways. As illustrated in the embodiment of FIG. 2, a pair of D-rings 202 may be attached near the remaining portion 204. As known in the art, the first end portion 108 may be extended around the target structure(s) and through the pair of D-rings. In order to secure strap 106, the first end portion 108 may then be wrapped around one of the D-rings, between the D-rings, and then under the other D-ring. As known in the art, this arrangement provides a simple, cost-effective, and convenient means for securing straps 106 around the target structure and attaching storage device 100 to the structure(s). One of ordinary skill in the art will appreciate that various alternative means may be employed for attaching straps 106. For example, any male-to-female, or other, fastening means may be employed. In certain embodiments, Velcro® may be used to attach the end portion 108 of straps 106 to support member 102.

Figures 3, 4:
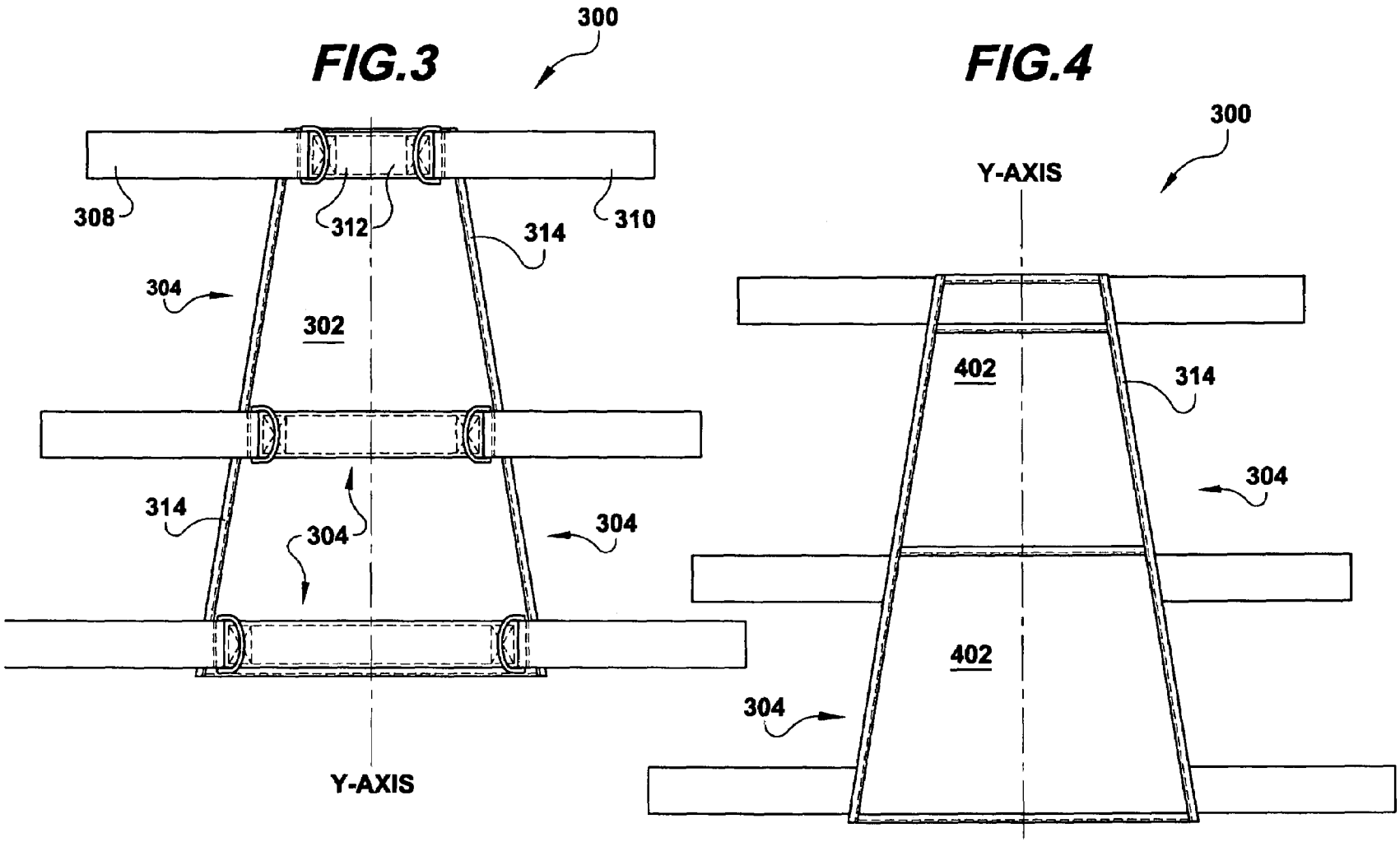
FIG. 3 is a back view of another embodiment of storage device for a boat.
FIG. 4 is a front view of the storage device of FIG. 3.

FIGS. 3 and 4 illustrate another embodiment of a storage device 300 for removably attaching to structure(s) on a boat of the types generally described above. As illustrated in FIG. 3, storage device 300 comprises a support member 302, pocket member(s) 402, and straps 306. Support member 302 provides an appropriate support or backing on which pocket member(s) 402 may be attached for forming a pocket in which various types of items may be stored. As illustrated in FIGS. 3 & 4, support member 302 has two opposing sides 304 (relative to vertical, longitudinal axis—y). As described below in more detail, opposing sides 304 are generally disposed in an oblique relationship to each other. In this manner, storage device 300 may advantageously be removably attached to two vertical structures which are disposed in an oblique relationship. There are a number of situations in which this unique configuration may be implemented. For example, many t-tops, hardtops, outriggers, towers, arches, covers, leaning posts, etc. include two opposing structures that are disposed in an oblique relationship to each other. Storage device 300 enables this additional space to be used for on-board storage.

Support member 302 and/or pocket member(s) 402 comprise a piece of marine fabric. One of ordinary skill in the art will appreciate that any of a number of alternative materials, fabrics, etc. may be used. For example, in certain embodiments, support member 302 and/or pocket member(s) 402 may comprise any of the following, or other materials: acrylic material, woven vinyl-coated polyester fabric, acrylic fiber, etc.

As briefly stated above, storage device 300 may comprise one or more pocket members 402, which may be attached to the front side of support member 302. Pocket member(s) 402 may be attached to, and positioned on, support member 302 in much the same manner as described above with respect to storage device 100.

Furthermore, storage device 300 may further comprise a reinforcing material 312 (e.g., acrylic binding material, canvas material, epoxy, etc.) which is attached to the various edges of support member 302 and/or pocket member(s) 402. For example, in the embodiment illustrated in FIGS. 3 & 4, reinforcing material 314 comprises an acrylic binding material which is stitched to various edges of support member 302 and pocket member 402. It should be appreciated that reinforcing material 314 may improve the durability of storage device 300 at, for example, the edges of the device where durability, wearing, rubbing, etc. may be an issue.

Storage device 300 may be removably attached to various structure(s) on a boat (e.g., obliquely-opposed, vertical structures, etc.) as described above via a plurality of straps 306. Straps 306 may comprise a variety of materials, fabrics, etc. In one embodiment, straps 306 comprise web strapping. Any number of straps 306 may be employed as necessary to attach storage device 300. For example, depending on factors such as the size of storage device 300, the number of pockets, the size, dimensions and weight of the items being stored, the spatial and structural orientation of the target structure(s), etc., additional straps 306 may be used.

As illustrated in FIG. 3, straps 306 may be attached to the back side (i.e., the opposite side of the pockets) of support member 302 in a substantially perpendicular relationship to the longitudinal axis (i.e., y-axis) of support member 302. Straps 306 may include a first end 308 for attaching to a first vertical structure and a second end 310 for attaching to a second vertical structure, which may be disposed in an oblique relationship to the first vertical structure.

It should be appreciated that straps 306 may be attached to the vertical structures in a number of ways. As illustrated in the embodiment of FIG. 3, first end 308 and second end 310 may each have a corresponding pair of D-rings 312 attached to support member 302 or strap 306. In the manner described above, the ends 308 and 310 of straps 306 may be wrapped around the corresponding vertical structure and through the corresponding pair of D-rings. In order to secure strap 306, the corresponding end 308 or 310 may then be wrapped around one of the D-rings, between the D-rings, and then under the other D-ring. As known in the art, this arrangement provides a simple, cost-effective, and convenient means for securing straps 306 around the vertical structures and attaching storage device 300. One of ordinary skill in the art will appreciate that various alternative means may be employed for attaching straps 106. For example, any male-to-female, or other, fastening means may be employed. In certain embodiments, Velcro® may be used to attach the ends 308 and 310 to support member 302 or strap 306.

Figure 7:
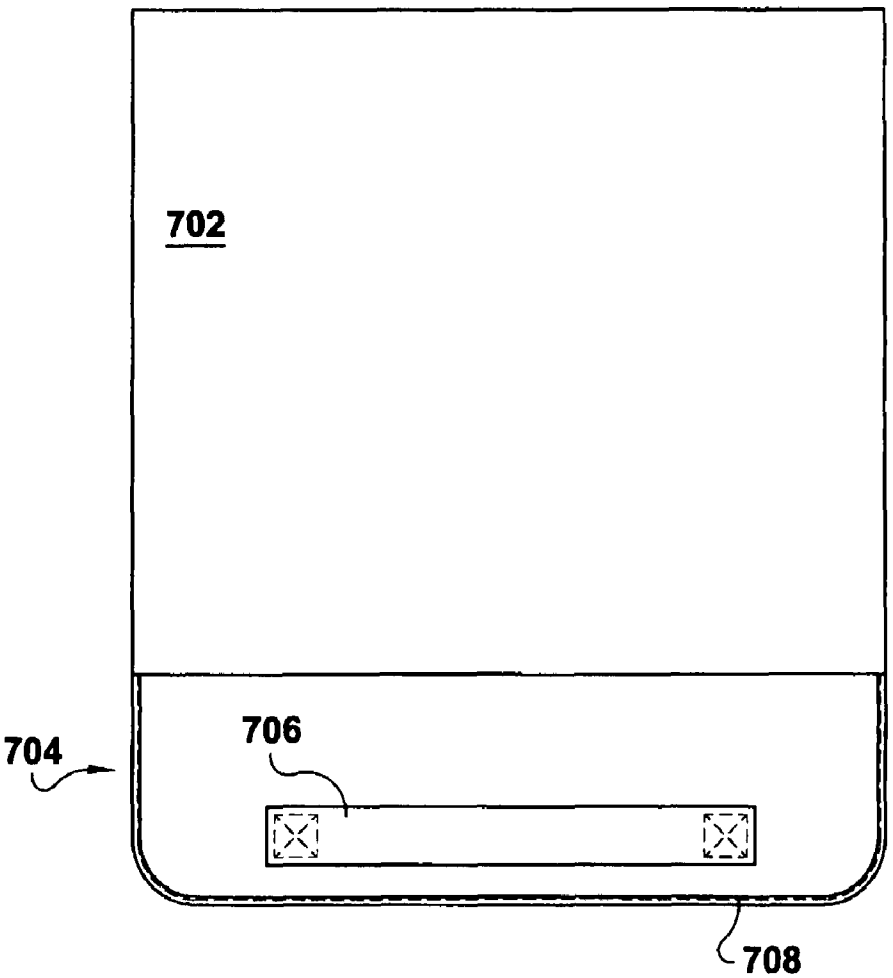
FIG. 7 illustrates the top portion and the access flap of the storage device of FIG. 6.
Figure 6:
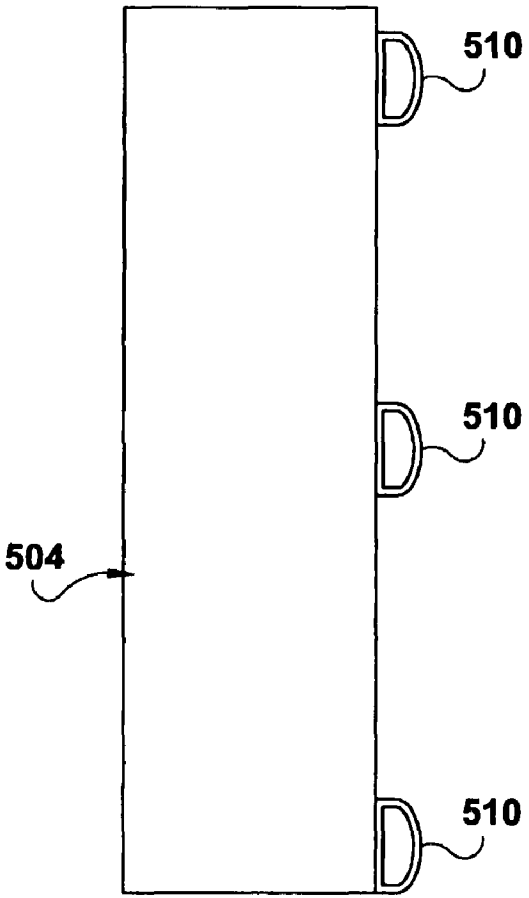
FIG. 6 is a side view of the storage device of FIG. 5.
Figure 8:
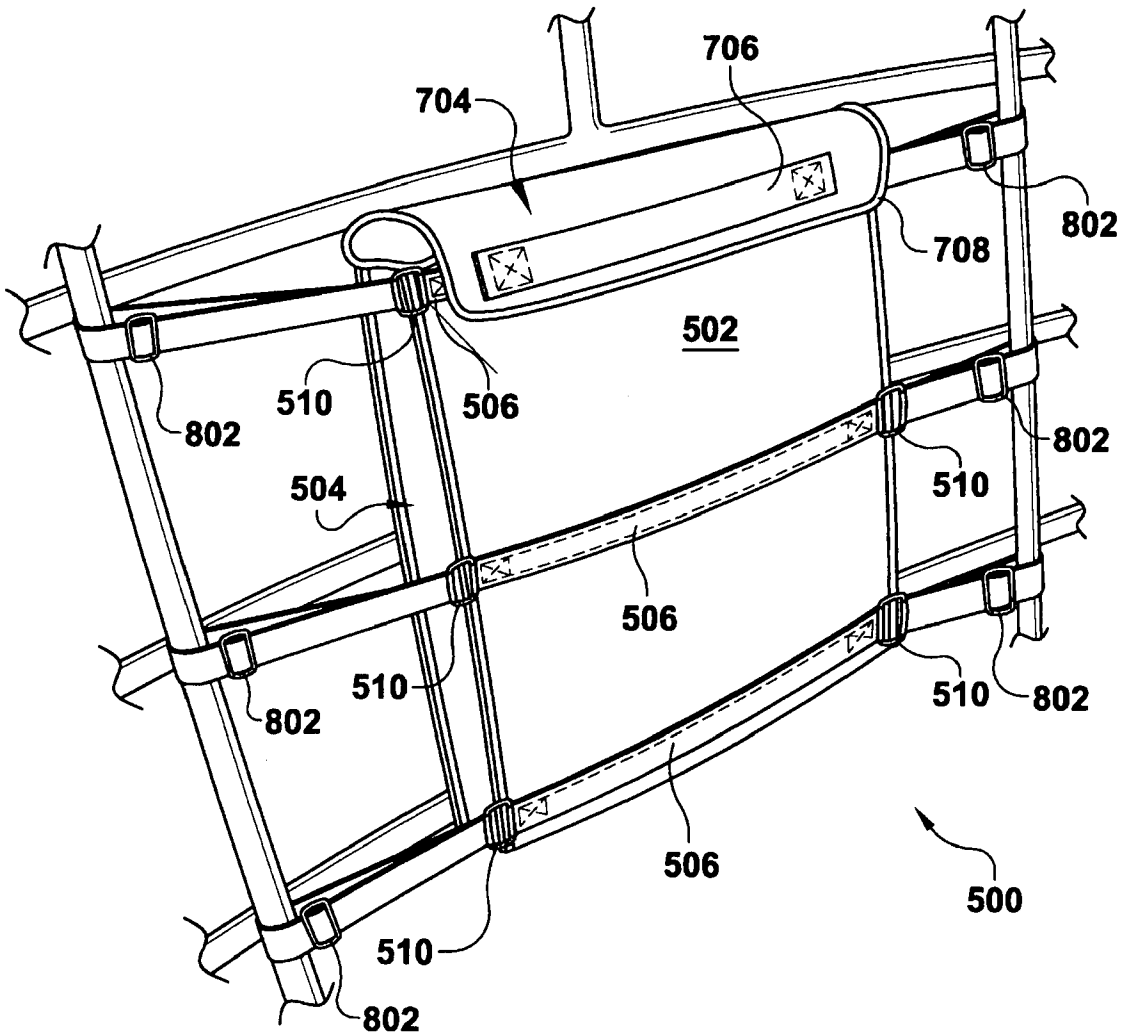
FIG. 8 is a perspective view of an embodiment of the storage device of FIGS. 5–7 illustrating an exemplary installation of the device on a t-top of a boat.

FIGS. 5–8 illustrate another embodiment of a storage device 500 for removably attaching to structures on a boat. As with the storage devices 100 and 300, storage device 500 may be attached to a number of different types of structure(s) on the boat. As best illustrated in FIG. 8, in one embodiment, storage device 500 is designed to removably attach to a t-top, or other similar structure, on a boat. For example, as known in the art, t-tops, towers, arches, etc. typically include two or more parallel pipes (typically made of aluminum) which are located above, and substantially parallel to the floor of the boat. As described in more detail below, storage device 500 may be removably attached to the piping of these structures and, thereby, provide convenient on-board storage.

Referring to FIGS. 5–8, storage device 500 may comprise a frame, an access flap 704, and straps 506. In general, the frame includes an opening to a storage area defined by the frame for storing/removing the items to be stored in the frame. Access flap 704 is attached to a portion of the frame and extends over the opening to another portion of the frame. In this manner, access flap 704 provides a convenient mechanism for enabling a user to access the storage area via the opening and store/remove items from the frame. Furthermore, access flap 704 provides a means for covering the opening in the frame and securing the items stored in the frame. A perspective view of an embodiment of storage device 500 (installed on one example of a target structure) is illustrated in FIG. 8.

It should be appreciated that the frame may be configured in a number of different ways and from various materials. For example, in the embodiment illustrated in FIGS. 5–8, the frame comprises a bottom portion 502, a top portion 702, two opposing side portions 504, and a back portion (not shown). As known in the art, bottom portion 502, top portion 702, side portions 504, and the back portion may be stitched together (or otherwise attached to each other) to form a five-sided frame having an opening opposite the back portion.

The frame and/or access flap may comprise a number of materials. For example, in the embodiment illustrated in FIGS. 5-8, bottom portion 502, top portion 702, side portions 504, the back portion, and access flap 704 comprise a piece of marine fabric. One of ordinary skill in the art will appreciate that any of a number of alternative materials, fabrics, etc. may be used. For example, in certain embodiments, the frame and/or access flap 704 may comprise any of the following, or other materials: acrylic material, woven vinyl-coated polyester fabric, acrylic fiber, etc. Furthermore, it should be appreciated that the frame may be manufactured in a variety of ways. For example, the frame need not be assembled from separate pieces of marine fabric, or other materials. Rather, the frame may be implemented as a single member, or two or more members formed to define the frame.

As best illustrated in FIG. 8, in one embodiment, access flap 704 is attached to top portion 702 and extends over the opening in the frame where it may be removably attached to bottom portion 502 to enable the user to easily access the storage area and remove/store items in the frame. In this regard, access flap 704 may further comprise a means for removably attaching access flap 704 to bottom portion 502. In one embodiment, access flap 704 comprises a securing strip 706 (FIG. 7) which includes Velcro® for removably attaching to a corresponding Velcro® element located on the frame. It should be appreciated that various alternative means may be employed for removably attaching access flap 704. For example, any male-to-female, or other, fastening means may be employed. In alternative embodiments, access flap 704 may attach to bottom portion 502 via a zipper.

Figure 5:
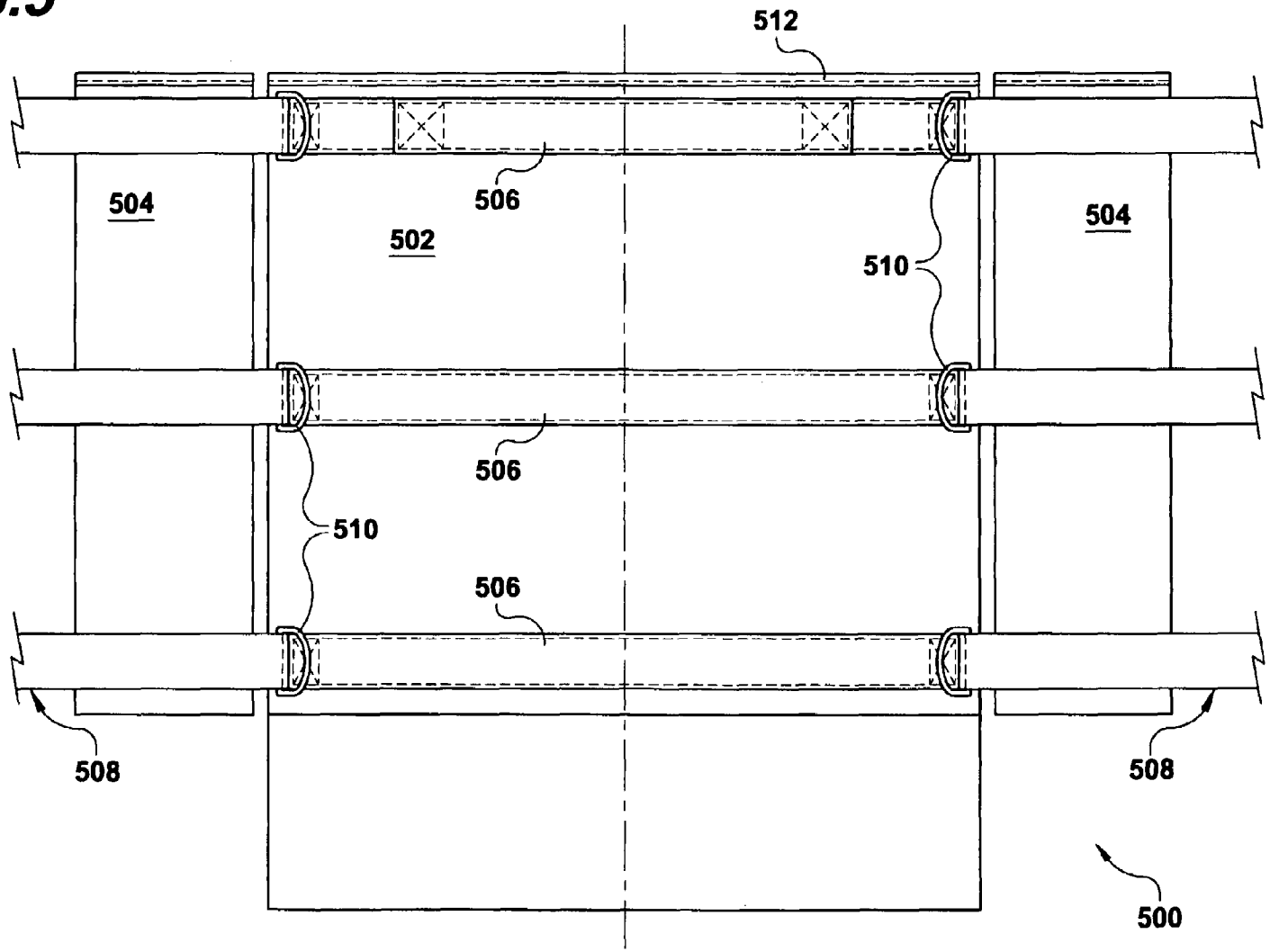
FIG. 5 is a bottom, fold-out view of another embodiment of a storage device for a boat which may be removably secured to a t-top of a boat.

Storage device 500 may further comprise a reinforcing material 708 and 512 (e.g., acrylic binding material, canvas material, epoxy, etc.) which is attached to the various edges of the frame and/or access flap 704. For example, as illustrated in FIGS. 5, 7, and 8, reinforcing material 708 and 512 comprises an acrylic binding material which is stitched to various edges of the frame and access flap 704. It should be appreciated that reinforcing material 512 and 708 may improve the durability of storage device 500 at, for example, the edges of the device where durability, wearing, rubbing, etc. may be an issue.

As stated above, storage device 500 may be removably attached to various structure(s) on a boat (e.g., t-tops, towers, arches, etc.) via a plurality of straps 506. Straps 506 may comprise a variety of materials, fabrics, etc. In one embodiment, straps 506 comprise web strapping. Any number of straps 506 may be employed as necessary to attach storage device 500. For example, depending on factors such as the size of storage device 500, the size, dimensions and weight of the items being stored, the spatial and structural orientation of the target structure(s), etc., additional straps 506 may be used.

As illustrated in FIG. 5, straps 506 may be attached to bottom portion 502. Straps 506 comprise a first end 508 for attaching to a first horizontal structure and a second end 512 for attaching to a second horizontal structure. It should be appreciated that storage device 500 may be removably attached to the target structure by attaching ends 508 and 512 to the respective horizontal structures. When storage device 500 is installed on the target structure, straps 502 are attached to the structure and provide support from underneath the frame. In this regard, it should be appreciated that the directional terms top, bottom, etc. refer to storage device 500 as it is installed. In other words, when storage device 500 is installed on, for example, a t-top, top portion 702 is disposed above bottom portion 502. Therefore, as stated above, access flap 704 may be easily engaged by a user, while at the same time, straps 502 provide support from underneath the frame (and, therefore, underneath the items stored in the frame).

One of ordinary skill in the art will appreciate that storage device 500 may provide a more secure installation, particularly where gravitational forces may strain the frame and/or straps 506 due to, for example, relatively massive items being stored in the frame. Furthermore, where the distance between the horizontal structures is relatively large, less massive items may still result in relatively large forces on the frame and/or straps 506. A simple example may illustrate this point. Consider the situation in which two people are holding opposite ends of a one-foot rope. If a heavy object is hung from the middle of the rope, very little strength is required to maintain the tension in the rope. However, if the rope were, for example, fifteen feet long, the same two people may not be able to maintain the tension in the rope when an object with much less mass is hung from the middle of the rope.

One of ordinary skill in the art will appreciate that straps 506 may be attached to the horizontal structures in a number of ways. In the embodiment illustrated in FIGS. 5–7, each end portion of straps 506 may have a corresponding pair of D-rings 510 attached to bottom portion 502 or strap 506. As known in the art, D-rings 510 provide a simple, cost-effective, and convenient means for securing straps 506 around the horizontal structures and attaching storage device 500. By way of example, the ends 508 and 512 may be wrapped around the corresponding horizontal structure and through the corresponding pair of D-rings. In order to secure strap 506, the corresponding end 508 or 510 may then be wrapped around one of the D-rings, between the D-rings, and then under the other D-ring. It should be appreciated that various alternative means may be employed for attaching straps 506. For example, any male-to-female, or other, fastening means may be employed.

As illustrated in FIG. 8, straps 506 may further comprise slides 802 for receiving extra length of straps 506 after storage device 500 is installed. Slides 802 may be made from a number of different materials, such as nylon, etc. Storage device 500 may provide a flexible installation system for securing the device to a number of different target structures. For example, where storage device 500 is installed on two horizontal structures that are disposed a relatively large distance from each, slides 802 may not be needed. However, if the distance between the horizontal structures is relatively smaller, extra length of straps 506 may be conveniently held by slides 802.

The above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included within the scope of this disclosure and the present invention and protected by the following claims.

The invention claimed is:

1. A storage device for removably attaching to structures on a boat and for storing items, the storage device comprising:

a support member comprising marine fabric having two opposing sides on a vertical longitudinal axis which are disposed in an oblique relationship to each other;

at least one pocket member comprising marine fabric which is attached to the support member for forming a pocket on the front side of the support member and for receiving an item to be stored on the boat; and a plurality of straps attached to the support member in a substantially perpendicular relationship to the longitudinal axis of the support member, each of the plurality of straps having a first end for attaching to a first vertical structure and a second end for attaching to a second vertical structure, the first and second vertical structures being disposed in an oblique relationship to each other.

2. The storage device of claim 1, wherein the support member and the at least one pocket member comprise an acrylic material.

3. The storage device of claim 1, wherein the support member and the at least one pocket member comprise a woven vinyl-coated polyester fabric.

4. The storage device of claim 1, wherein the edges of the support member and the pocket member are reinforced with an acrylic binding material.

5. The storage device of claim 1, wherein the plurality of straps comprise web strapping.

6. The storage device of claim 1 wherein one of the plurality of straps is positioned at the top of the support member and another of the plurality of straps is positioned at the bottom of the support member.

7. The storage device of claim 6, further comprising:

a first pair of D-rings attached to the first end of one of the plurality of straps for attaching the storage device to the first vertical structure; and a second pair of D-rings attached to the second end of the one of the plurality of straps for attaching the storage device to the second vertical structure.

8. The storage device of claim 1, wherein at least two pocket members are attached to the support member to form two vertically-aligned pockets.

9. The storage device of claim 1, wherein at least two pocket members are attached to the support member to form two horizontally-aligned pockets.

10. The storage device of claim 1, wherein the support member is sized to fit between the first and second vertical structures to which the plurality of straps are to be attached.

* * * * *